US007728775B2

(12) United States Patent
Shachar et al.

(10) Patent No.: US 7,728,775 B2
(45) Date of Patent: Jun. 1, 2010

(54) RADIATOR FOR AN RF COMMUNICATION DEVICE

(75) Inventors: Aviv Shachar, Ramat-Gan (IL); Motti Elkobi, Tel Aviv (IL)

(73) Assignee: Motorola, Inc., Schaumburg, IL (US)

( * ) Notice: Subject to any disclaimer, the term of this patent is extended or adjusted under 35 U.S.C. 154(b) by 426 days.

(21) Appl. No.: 11/736,863

(22) Filed: Apr. 18, 2007

(65) Prior Publication Data

US 2007/0252766 A1 Nov. 1, 2007

(30) Foreign Application Priority Data

Apr. 28, 2006 (GB) ..... 0608364.6

(51) Int. Cl.
*H01Q 1/24* (2006.01)

(52) U.S. Cl. ..... 343/702

(58) Field of Classification Search ..... 343/702, 343/700 MS, 795, 895, 829, 846
See application file for complete search history.

(56) References Cited

U.S. PATENT DOCUMENTS

| | | | | |
|---|---|---|---|---|
| 5,166,697 | A | 11/1992 | Viladevall | |
| 5,557,293 | A * | 9/1996 | McCoy et al. | 343/867 |
| 6,326,919 | B1 | 12/2001 | Diximus | |
| 6,448,932 | B1 | 9/2002 | Stoiljkovic | |
| 6,922,171 | B2 * | 7/2005 | Annamaa et al. | 343/700 MS |
| 7,271,769 | B2 * | 9/2007 | Asano et al. | 343/702 |
| 7,436,360 | B2 * | 10/2008 | Chen et al. | 343/700 MS |
| 7,538,729 | B2 * | 5/2009 | Lin et al. | 343/700 MS |
| 2001/0045908 | A1 * | 11/2001 | Keilen | 343/700 MS |
| 2002/0021249 | A1 | 2/2002 | Kuck | |
| 2006/0017620 | A1 * | 1/2006 | Chen et al. | 343/700 MS |
| 2008/0198088 | A1 * | 8/2008 | Lin et al. | 343/850 |

FOREIGN PATENT DOCUMENTS

| | | | |
|---|---|---|---|
| EP | 1018779 | A2 | 6/2004 |
| EP | 1478047 | A1 | 10/2007 |
| JP | 09083242 | A | 3/1997 |
| WO | WO0054637 | A1 | 9/2000 |

OTHER PUBLICATIONS

GB Search Report Dated Aug. 29, 2006.

* cited by examiner

*Primary Examiner*—Huedung Mancuso
(74) *Attorney, Agent, or Firm*—Randi L. Karpinia; Anthony P. Curtis

(57) ABSTRACT

A radiator for an RF communication device (100) including a first member (311, 600) including a first conducting surface (601, 603) operable to provide a radiating surface, a second member (301) including a second conducting surface (303) operable to provide a near field reflector or ground plane surface, the first conducting surface and the second conducting surface being galvanically connected (by 401), wherein the first conducting surface is disposed at an angle relative to the second conducting surface and the first conducting surface includes a first conducting region (601) and a second conducting region (601) having between them a gap (621) having a portion (629) which is tapered.

24 Claims, 5 Drawing Sheets

RADIATOR FOR AN RF COMMUNICATION DEVICE

FIELD OF THE INVENTION

The present invention relates to a radiator for an RF (radio frequency) communication device. In particular, the invention relates to a radiator for use in a portable or handheld communication device.

BACKGROUND OF THE INVENTION

Portable handheld RF communication devices such as cellular telephones, portable radios, data communication devices, and the like employ a radiator or antenna to radiate and receive RF signals. Monopole antennas are widely used as RF radiators in such devices. As such communication devices become more complex, e.g. by the incorporation of additional functional components such as cameras, advanced loudspeakers, and the like, extra functional requirements are imposed on the radiator system. There is also an ongoing search for ways to reduce the overall size and weight of such devices, including the radiator system.

Thus, it is expected in the future that the space available in a portable communication device for the radiator will decrease, since the overall size of the device will continue to decrease and/or the device will have to accommodate other functional components at the expense of the radiator. However, reducing the radiator size may negatively impact radiator gain and bandwidth. This follows from the fact that a radiator is used to transform a bounded wave into a radiating wave. However, when the dimensions of the radiator are much smaller than the wavelength of the RF radiation to be transmitted, the radiator performs this transformation with only a poor efficiency. The loss in radiator gain can to some extent be compensated for by amplification. However, this causes a greater energy consumption, e.g. from a battery of the device.

Another challenging task is that the distance available between the radiator and other components of the communication device, such as a camera unit or an advanced loudspeaker, is likely to be reduced as well. This requires careful selection of where components are placed in the communication device to give suitable operation of the radiator.

Thus there is a need for a new radiator (antenna) which addresses the above problems.

SUMMARY OF THE INVENTION

According to the present invention in a first aspect there is provided a radiator as defined in claim 1 of the accompanying claims.

Further features of the present invention are as defined in the accompanying dependent claims and are disclosed in the embodiments of the invention to be described.

Embodiments of the present invention will now be described by way of example with reference to the accompanying drawings, in which:

DESCRIPTION OF EMBODIMENTS OF THE INVENTION

In embodiments of the invention to be described a radiator for an RF communication device includes a first member including a first conducting surface operable to provide a radiating surface, a second member including a second conducting surface operable to provide a near field reflector or ground plane, the first conducting surface and the second conducting surface being galvanically connected, wherein the first conducting surface is sloping relative to the second conducting surface and the first conducting surface includes a first conducting region and a second conducting region having between them a gap including at least a portion which is tapered.

The radiator may include at least one contact area on the first conducting surface to receive a feed conductor to feed RF electrical signals to and from the first and second conducting regions.

The first and second conducting regions of the radiator may be separate regions and the gap may extend between the first and second conducting regions to separate them.

The first member may comprise a first insulating substrate having thereon a first conducting layer providing the first conducting surface; and the second member may comprise a second insulating substrate having thereon a second conducting layer providing the second conducting surface. The first and second insulating substrates may conveniently be made of printed circuit board material and the first and second conducting layers may be metallic layers, e.g. of copper, each formed on a surface of each substrate in a known manner. The first insulating substrate and the first conducting layer thereon may be shaped to facilitate suitable operation of the radiator as will be illustrated in the embodiments of the invention to be described.

Figure 1:
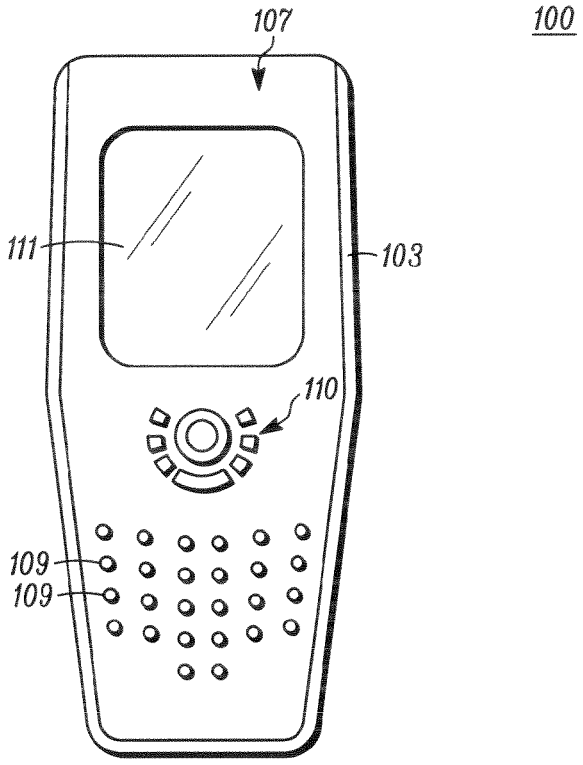
FIG. 1 is a front view of an RF communication device.
Figure 2:
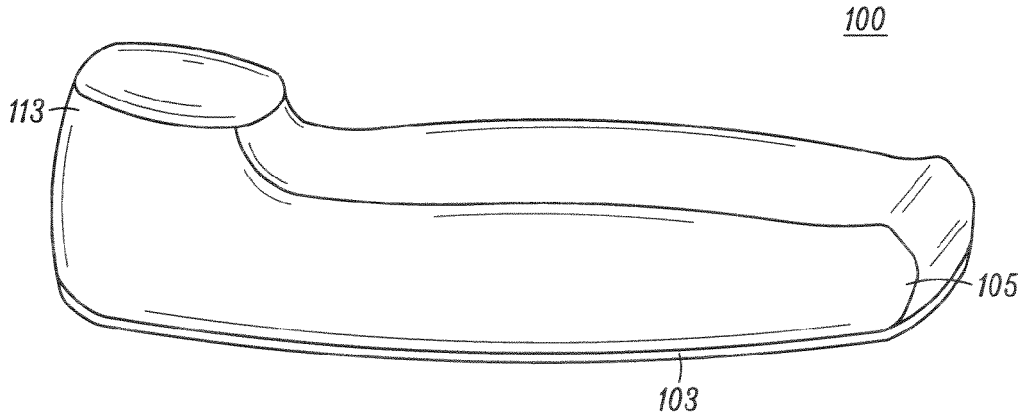
FIG. 2 is a rear perspective view of the device shown in FIG. 1.

FIG. 1 is a front view of an illustrative RF communication device 100 embodying the invention and FIG. 2 is a rear perspective view of the device 100. The device 100 is a handset for voice and/or data communications and includes a casing having a front portion 103 which is relatively flat and a rear portion 105 for fitting to the front portion 103 which has shape resembling that of a shoe as shown in FIG. 2. A front surface 107 of the front portion 103 of the casing includes in a lower region a keypad 109 and various buttons and control actuators 110 for data entry and function control. The front surface 107 includes in an upper region a display 111 for the display of data. The rear portion 105 includes a protruding portion 113 (behind the upper region of the front surface 107)

which facilitates incorporation of operational components to be described including a radiator embodying the invention (although application of the invention is not limited to devices having the specific shape shown in FIGS. 1 and 2).

Figure 3:
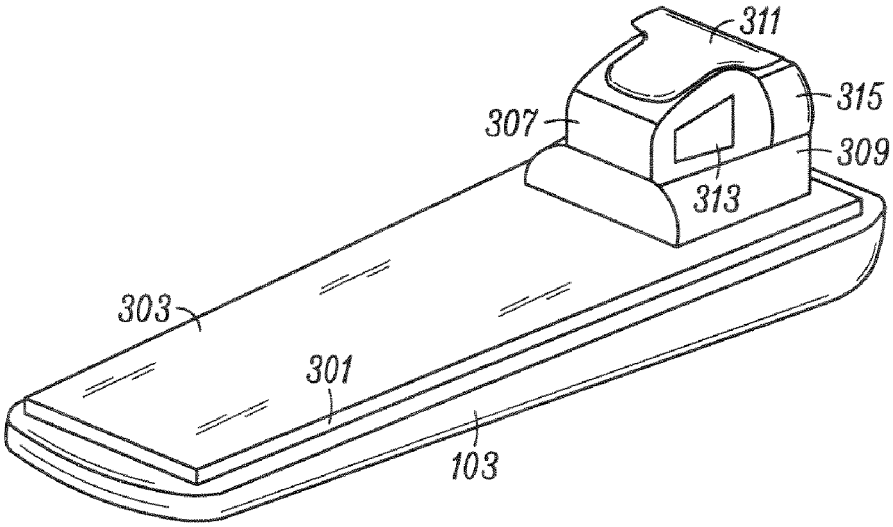
FIG. 3 is a rear perspective view of a front portion of the casing of the device shown in FIG. 1 showing some internal components of the device.

FIG. 3 is a rear perspective view (shown from behind the front face 107) of the front portion 103 of the casing of the device 100. In FIG. 3, the rear portion 105 of the casing is removed to show internal components mounted internally on the front portion 103. The end of the front portion 103 shown to the right in FIG. 3 corresponds to the upper end shown in FIG. 1. The front portion 103 includes an insulating board 301, made for example of printed circuit board material, which serves as an insulating substrate. The insulating board 301 has a shape matching that of the front portion 103 and a size which is marginally smaller than that of the front portion 103 to allow fitting of the insulating board 301 in the front portion 103 of the casing. The front portion 103 may have around the insulating board 301 conventional edge features including holes allowing the rear portion 105 of the casing to be fitted to the front portion 103 by fasteners when required. For simplicity, these conventional features are not shown The insulating board 301 has on its surface (the surface shown in FIG. 3) a conducting layer 303 which is described in more detail later. The insulating board 301 having thereon the conducting layer 303 comprises the second member of the radiator embodying the invention referred to earlier. The insulating board 301 may also carry circuit components (not shown) on its other face (beneath the face having the conducting layer 303 as shown in FIG. 3).

A first insulating body 307 and a second insulating body 315 are mounted on an insulating pedestal 309 on the insulating board 301 near an upper end of the front portion 103. The insulating body 307 may comprise a case housing a component device of the device 100 such as an image processing unit. The insulating body 315 may comprise a case housing a further component device of the device 100, e.g. an imaging camera. The insulating body 307 carries on a rear face (a face which is shown uppermost in FIG. 3) a first member of a radiator embodying the invention comprising a first antenna portion 311 and carries on a side face a second antenna portion 313. The first antenna portion 311 and the second antenna portion 313 are described in more detail later, especially with reference to FIGS. 6 to 9.

Figure 4:
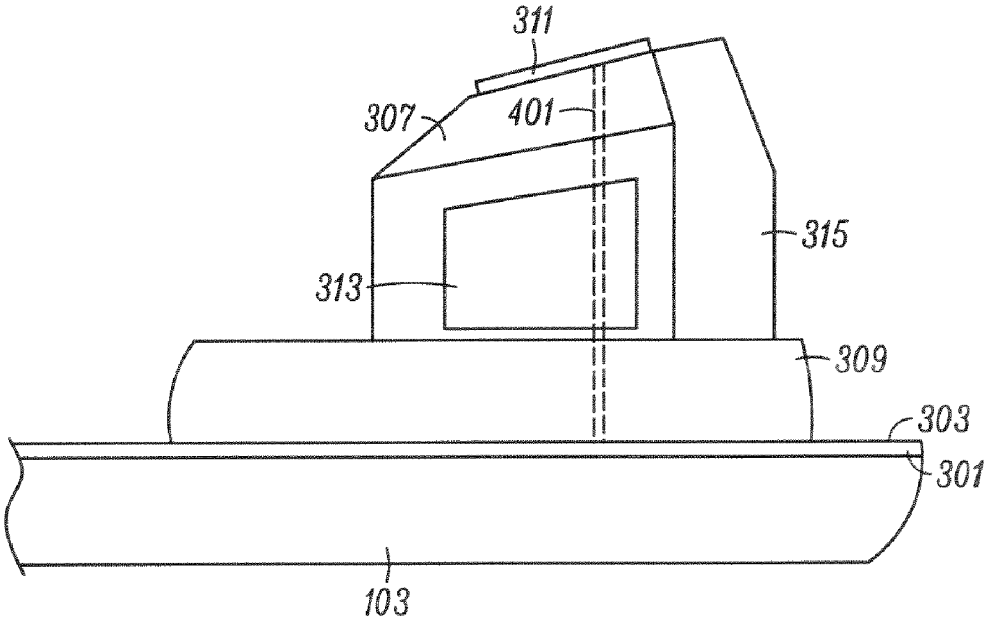
FIG. 4 is a side view of the front portion of the casing shown in FIG. 3, showing some components as in FIG. 3.

FIG. 4 is a side view of the front portion 103. The end of the front portion 103 shown to the right in FIG. 4 corresponds to the upper end shown in FIG. 1. FIG. 4 shows components seen in FIG. 3. As shown in FIG. 4, the rear face (the face shown uppermost in FIG. 4) of the body 307, and thereby the first antenna portion 311 thereon, is sloping relative to the insulating board 301 and the conducting layer 303 thereon. This comprises the sloping between the first and second conducting surfaces of the radiator embodying the invention as referred to earlier. A stub connector 401 indicated by dashed lines in FIG. 4 extends vertically inside the body 307 and the pedestal 309 from the first antenna portion 311 to the conducting layer 303 of the insulating board 301 to provide a galvanic connection between the first antenna portion 311 and the conducting layer 303 of the insulating board 301. The first antenna portion 311 may have a conducting surface connected to the conducting layer 303 which has a surface area much smaller than, e.g. less than one tenth of, that of the conducting layer 303.

Figure 5:
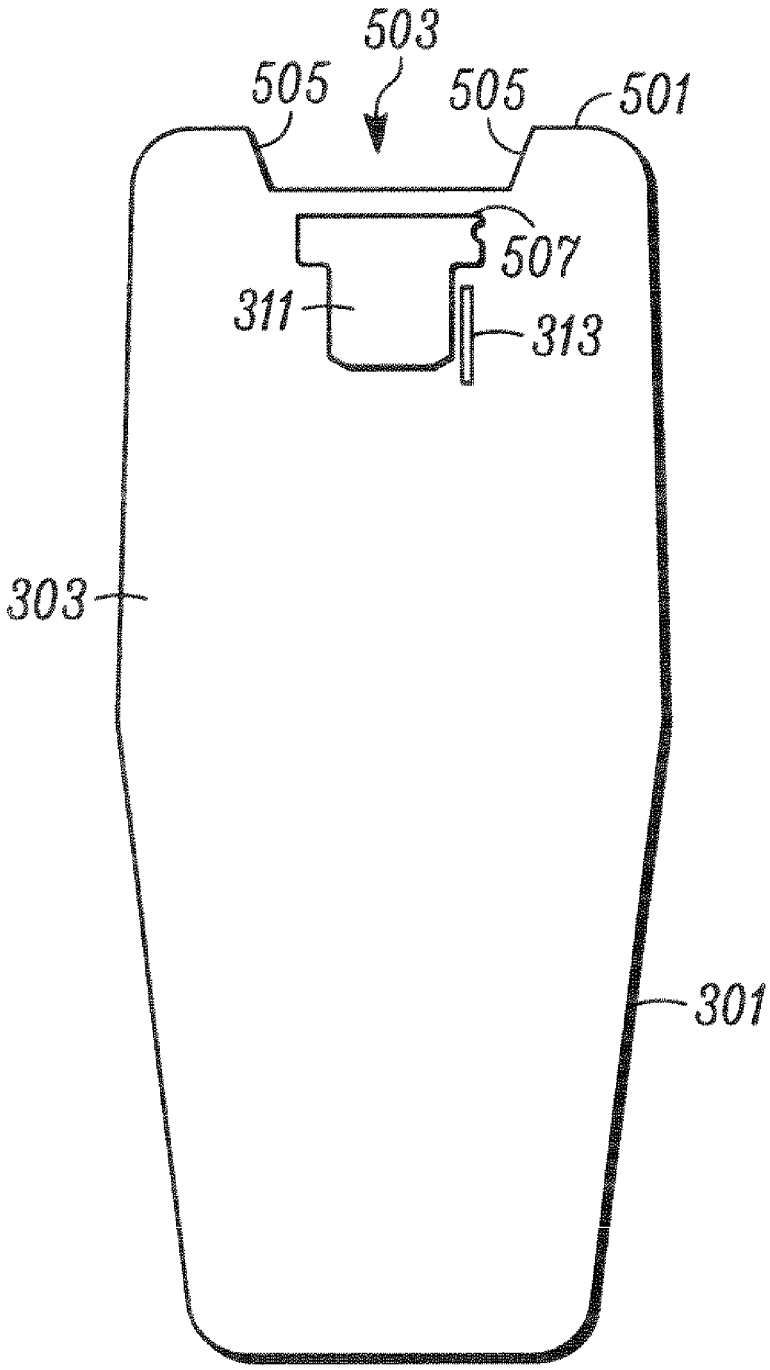
FIG. 5 is a rear view of an insulating board included as a component in FIGS. 3 and 4 showing a projection (on a plane of the board) of antenna portions also included as components in FIGS. 3 and 4.

FIG. 5 is a front view of the insulating board 301 showing the first antenna portion 311 and the second antenna portion 313 but with other parts removed to illustrate further a relative configuration of the insulating board 301 and the first antenna portion 311 and the second antenna portion 313. The first antenna portion 301 and the second antenna portion 313 are near an upper end of the insulating board 101 (corresponding to an upper end of the front portion 103 which is not shown in FIG. 5).

In operation, to be described in more detail later, the conducting layer 303, galvanically connected to the first antenna portion 311 by the stub connector 401, forms the first conducting surface, referred to earlier, of a radiator embodying the invention. That is, the conducting layer 303 provides a near field reflector known in the art as a ground plane (or alternatively as a counterpoise) for the first antenna portion 311 which provides the second conducting surface, referred to earlier, of the radiator embodying the invention. The conducting layer 303 may also form a ground plane for the second antenna portion 313. As known by those skilled in the art, a ground plane of a radiator is a conducting surface which serves as a near field reflector to allow normal operation of the radiator.

As shown in FIG. 5, the insulating board 301 has formed in its shape at an edge 501 at its upper end a recess 503 having sides 505 which slope inward (toward a central region of the board 301) relative to one another. The conducting layer 303 thereby has the same shape including the recess 503. It is to be noted that the recess 503 is near to an upper edge 507 of the first antenna portion 311 when projected as in FIG. 5 onto the plane of the board 301 (although the upper edge 507 is separated vertically from the insulating board 301 including the recess 503 by the body 307 and the pedestal 309 as shown in FIG. 4). The upper edge of the antenna portion 311 is at an end of the antenna portion 311 which is furthest from the conducting layer 303.

Figure 6:
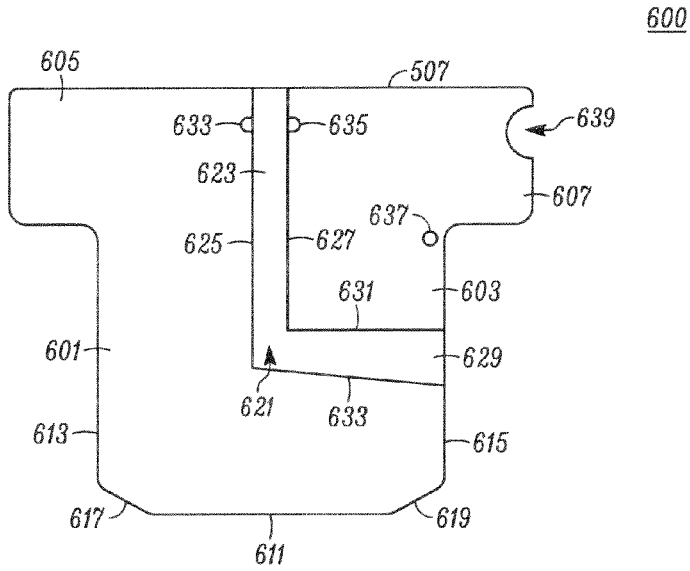
FIG. 6 is front view of an illustrative antenna portion of a radiator embodying the invention suitable for use as a first antenna portion shown in FIGS. 3 to 5.

FIG. 6 shows an antenna portion 600 suitable for use as the first antenna portion 311. The upper edge 507 of the first antenna portion 311 shown in FIG. 5 is shown again in FIG. 6. The antenna portion 600 comprises a shaped insulating board, e.g. made of material similar to that employed to produce the board 301, providing an insulating substrate. The board has conducting material, e.g. metallic material, formed on its surface providing the first conducting surface of the radiator embodying the invention as referred to earlier. The conducting material is provided in shaped conducting regions 601 and 603 which comprise respectively the first and second conducting regions of the first member of the radiator embodying the invention as referred to earlier. The conducting material of the conducting regions 601 and 603 covers the front surface of the antenna portion 600 shown in FIG. 6 except where a gap 621 is formed. The antenna portion 600 has at its upper end a wing portion 605 which includes part of the conducting region 601 and a wing portion 607 which includes part of the conducting region 603. The upper edge 507 extends between the wing portions 605 and 607 and forms an upper straight edge of the wing portions 605 and 607. The antenna portion 600 has a body portion beneath the wing portions 605 and 607 including side edges 613 and 615 extending from the wing portions 605 and 607 to a lower edge 611 of the antenna portion 600. Bevelled (cut away) corners 617 and 619 are provided between the lower edge 611 and the side edges 613 and 615 respectively.

As noted earlier, a gap 621 is formed between the conducting regions 601 and 603, thereby exposing insulating material of the board on which the regions 601 and 603 are formed. The gap 621 includes a first portion 623 extending from a region mid-way along the upper edge 507 in a direction perpendicular to the upper edge 507. The first portion 623 of the gap 621 has parallel sides 625 and 627 formed by edges of the regions 601 and 603. The gap 621 has a second portion 629 extending from the first portion 623 to the side edge 615.

The second portion 629 of the gap 621 has sides 631 and 633 formed by edges of the regions 601 and 603. The side 631 is perpendicular to the sides 627 and 629. The side 633 is not parallel to the side 631 but instead is disposed at a small acute angle relative to the side 631. The small acute angle may be between one degree and twelve degrees, particularly between three degrees and nine degrees, e.g. six degrees. The gap 621 thereby has a shape in the second portion 629 which is tapered such that the gap is wider at the edge 615 than where it joins the first portion 623.

A small area 633 of the region 601 adjacent to the gap 621 near the upper edge 507 and a similar small area 635 of the region 603 adjacent to the gap 621 near the upper edge 507 form contact areas for a feed conductor (not shown), e.g. an inner conductor of a coaxial cable, for delivery of RF electrical signals between the first antenna portion 311 and an RF transceiver (not shown) housed inside the device 100. The stub connector 401 shown in FIG. 4 makes contact with the region 603 in a small contact area 637. The wing 607 includes a semi-circular recess 639 which facilitates fitting of an insulated feed conductor (not shown), e.g. a coaxial cable, across the first antenna to the areas 633 and 635.

The first antenna portion 311, e.g. the antenna portion 600, operating in conjunction with its associated ground plane provided by the metallic conducting layer 303 on the insulating board 301, provides a novel radiator embodying the invention which beneficially can provide very attractive properties, particularly a very wide operational resonance band with a controlled impedance as illustrated later. The disposition of the conducting regions 601 and 603 relative to the ground plane provided by the conducting layer 303 and the shape of the conducting regions 601 and 603 and the gap 621 between them allow good radiator efficiency to be obtained by providing reduced reactive impedance. In other words, substantially all of the RF energy transformed by the antenna portion 600 from conducted energy to energy radiated in free space (or vice versa) will essentially be transformed without reactive impedance losses. In addition, the recess in the conducting layer 303 at the recess 503 of the insulating board 301 plays a useful role in encouraging diffraction effects from electrical currents in the adjacent metallic conducting layer 303 (i.e. in the adjacent part of the ground plane) which in turn allows a wide angle radiation beam to be obtained from the first antenna portion 311, e.g. the antenna portion 600.

In a particular example, the insulating board 301 and the antenna portion 600 have the following properties which are exemplary only to illustrate results which may be obtained:

1) The insulating board 301 has a length (longest dimension) of 181 (one hundred and eighty one) millimeters and a width at the upper edge (including the recess 503) of 67.5 (sixty seven point five) millimeters.

2) The insulating board 301 and the insulating board of the antenna portion 600 are made of the industry standard material FR4 (commonly used in printed circuit board manufacture) having a thickness of 1.6 millimeters, and dielectric properties of $\epsilon_r$=4.5 (where $\epsilon_r$ is relative permittivity) and tan $\delta$=0.019 (where tan $\delta$ is loss factor or tangent of loss angle).

3) The metallic conducting layer 303 on the insulating board 101, and the metallic conducting material on the antenna portion 600 to form the conducting regions 601 and 603, is copper having a thickness of 0.018 millimeters deposited and shaped in a known manner.

4) The antenna portion 600 including the conducting regions 601 and 603 is disposed at an angle of 15 (fifteen) degrees relative to the conducting layer 303 on the insulating board 301.

5) The antenna portion 600 has the following dimensions: length of the edge 507: 32.5 (thirty two point five) millimeters; distance between the edge 507 and the side 611: 25.2 (twenty five point two) millimeters; length of the first portion 623 of the gap 621 (from the side 507 to the side 633): 18 (eighteen) millimeters; width of the first portion 623 of the gap 621: 1.2 (one point two) millimeters; length of the second portion 629 of the gap 621 (to the side 625): 11 (eleven) millimeters; width of the second portion 629 of the gap 621: 4 (four) millimeters; angle of slope of the side 633 relative to the side 631: 6 (six) degrees.

6) The electrical length of the antenna portion 600 was increased by a factor of about 1.3 by the presence of parasitic capacitance from metallic parts (not shown) of the body 315 acting as a case housing the parts.

Figure 7:
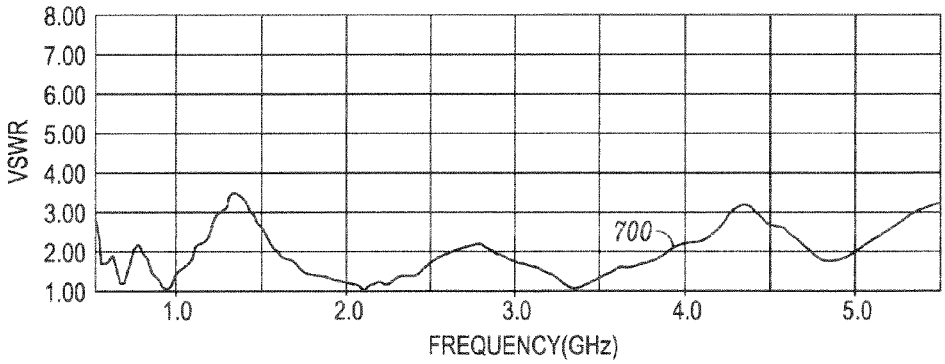
FIG. 7 is a graph of VSWR (voltage standing wave ratio) versus frequency obtained for a particular example of the antenna portion shown in FIG. 6.

Using the particular example described above for the antenna portion 600 (as the first antenna portion 311) and the insulating board 301, the following measurement results were obtained:

(i) The VSWR (voltage standing wave ratio) as a function of operational frequency in GigaHertz (GHz) was measured and the results obtained are plotted as a curve 700 as shown in FIG. 7. It is to be noted that the value of VSWR surprisingly and beneficially is low, particularly below 2.00 (two), at a number of different frequencies across a very wide band, particularly at 806 (eight hundred and six) MHz (MegaHertz) MHz (VSWR=1.98); 2.17 (two point one seven) GHz (GigaHertz) (VSWR=1.26); 2.40 (two point four) GHz (VSWR=1.29); 2.48 (two point four eight) GHz (VSWR=1.46) and 4.9 (four point nine) GHz (VSWR=1.95). This indicates suitable resonance performance at the measured frequencies;

(ii) The radiation pattern (gain) performance was measured at various frequencies of interest in the frequency range illustrated by the curve 700 and the measurement results which were obtained are as summarised in Table 1 as follows:

TABLE 1

| Frequency (GigaHertz) | Related system of interest | Directivity (dBi) (decibels over isotropic) | Gain (dBi) |
|---|---|---|---|
| 0.9 | GSM (Global System for Mobile communications) | 2.45 | 2.40 |
| 1.575 | GPS (Global Positioning System) | 2.73 | 2.68 |
| 1.85 | DCS/PCS (Digital Cellular System/Personal Communications Service) | 2.69 | 2.65 |
| 2.0 | UMTS (Universal Mobile Telecommunication System) | 2.86 | 2.83 |
| 2.44 | Bluetooth$^{RTM}$/WLAN (Wireless Local Area Network) Standards 802.11a/b/g and 802.15 | 3.19 | 3.16 |
| 5.0 | WLAN Standards 802.11b/g | 7.00 | 6.00 |

The results shown in Table 1 indicate good performance at all of the measured frequencies, with substantially omnidirectional radiation patterns. Similar results were obtained when the dimensions of the metallic conducting layer 303 on the insulating board 301 were reduced to a length of 85 mm and a width of 42 mm (with the recess 503 in the same position as shown in FIG. 5).

The second column in Table 1 indicates well known systems operating at the frequencies indicated in the first column thereby providing applications in which the device 100 embodying the invention may operate using the radiator provided by the first antenna portion 311 and the insulating board 301 including the conducting layer 303.

Figure 8:
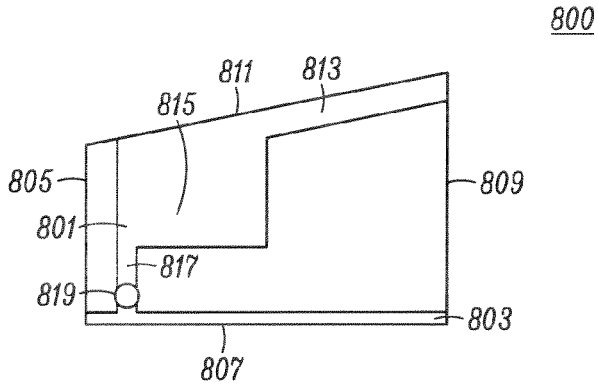
FIG. 8 is a front view of an illustrative antenna portion suitable for use as a second antenna portion shown in FIGS. 3 to 5.

FIG. 8 shows an antenna portion 800 suitable for use as the second antenna portion 313 shown in FIG. 4. Like the antenna portion 600, the antenna portion 800 comprises a shaped insulating board (made of material similar to that employed to produce the board 301) having conducting, e.g. metallic, regions 801 and 803 formed on its surface. The antenna portion 800 has edges 805 and 807 which are mutually perpendicular and a third edge 809 which is perpendicular to the edge 807. A fourth edge 811 joins the edges 805 and 809, the edge 809 being longer than the edge 805. The conducting region 803 comprises a narrow strip leading from a contact area 819 adjacent to the edge 807. The region 801 includes a narrow portion 813 adjacent to the edge 811, an approximately square portion 815 and a short narrow portion 815 between the contact area 819 and the approximately square portion 815. The contact area 819 is contacted by a feed conductor (not shown), e.g. an inner conductor of a coaxial cable or an RF connector, for delivery of RF electrical signals between the antenna portion 800 and an RF transceiver (not shown) inside the device 100.

The antenna portion 800 provides a quasi quarter wave radiator in which the radiating metallic conducting material resembles a known 'inverted L' antenna shape. The strip 803 is employed to provide a galvanic connection (not shown) to the ground plane provided by the conducting layer 303.

In operation, the first antenna portion 311 and the second antenna portion 313, e.g. the antenna portion 800, operate to transform RF signals between electrical signals carried by a feed conductor (not shown) and radiated electromagnetic waves sent over the air, and vice versa. The first antenna portion 311 and the second antenna portion 313 may provide polarisation diversity for a given signal at 2.44 and 4.9 GHz. In other words, the polarisation components of the signal at each of the selected frequencies differ in the two antenna portions giving a better overall polarisation coverage. This may be important in some applications such as wireless local area networks used in indoors or in urban outdoor environments in which an RF radiated signal may undergo several reflections and scatterings which may change its polarisation significantly. The mutual disposition of the first antenna portion 311 and the second antenna portion 313, with the second antenna portion 313 mounted in a plane perpendicular to that of the first antenna portion 311, e.g. at an end of the gap 621 distant from the contact areas 633 and 635 at which RF current is delivered into and out of the antenna portion 600, allows operation of the antenna portions 311 and 313 without substantial coupling or mutual interference. In other words, there is a substantial electrical isolation between the first antenna portion 311, e.g. the antenna portion 600, and the second antenna portion 313, e.g. the antenna portion 800, of about 15 dB (decibels).

Figure 9:
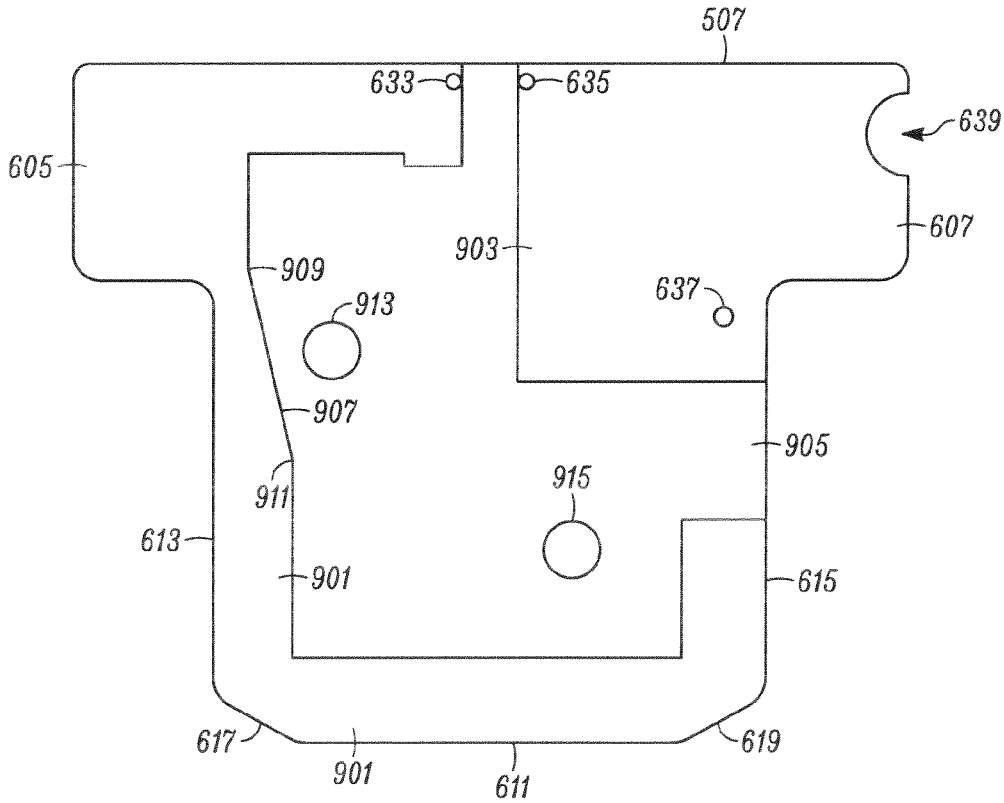
FIG. 9 is a front view of an alternative illustrative antenna portion of a radiator embodying the invention suitable for use as a first antenna portion shown in FIGS. 3 to 5.

FIG. 9 shows an alternative antenna portion 900 suitable instead of the antenna portion 600 for use as the first antenna portion 311. The upper edge 507 of the first antenna portion 311 shown in FIG. 5 is shown again in FIG. 6. Parts of the antenna portion 900 shown in FIG. 9 which are the same as parts of the antenna portion 600 shown in FIG. 6 have the same reference numerals in FIG. 9. In the antenna portion 900, the conducting regions 601 and 603 in the antenna portion 600 are replaced respectively by conducting regions 901 and 903, e.g. made of metallic material such as copper. A gap 905 is formed between the regions 901 and 903. The gap 905 is wider than the gap 621 in the antenna portion 600 and has more sides adjacent to edges of the antenna portion 900. The region 901 is narrower than the region 601 and the region 903 is shorter (measured in distance from the edge 507) than the region 603. It is to be noted that the gap 905 has a side edge 907 (formed by an inner edge of the region 901) which is sloping relative to the edge 613 of the antenna portion 900. The sloping side portion 907 has an upper end 909 which is level with part of the region 903 and a lower end 911 which is lower than the region 903. Also shown in FIG. 9 are holes 913 and 915 through the antenna portion 900 which allow the antenna portion 900 to be attached to the case 307 (FIGS. 3 and 4) by fasteners (not shown).

The antenna portion 900 is aimed principally at operation in a frequency band that includes 806 (eight hundred and six) MegaHertz and 960 (nine hundred and sixty) MegaHertz. The antenna portion 900 is suitable to give similar gain results as for the antenna portion 600 at these frequencies but may be formed using less conducting material to form the conducting regions 901 and 903.

A particular example of the antenna portion 900, made from the same materials and having the same outer dimensions and the same ground plane as for the particular example of the antenna portion 600 specified above, gave the following measurement results:

(i) VSWR at 806 MHz: 1.692;
(ii) VSWR at 960 MHz: 1.964;
(iii) directivity at 900 MHz: 2.45 dBi
(iv) gain at 900 MHz: 2.40 dBi These results obtained indicate good performance at the measured frequencies, with omnidirectional radiation patterns.

Similar results were obtained when the dimensions of the conducting layer 303 on the insulating board 301 providing a ground plane were reduced to a length of 85 mm and a width of 42 mm (with the recess 503 in the same position as shown in FIG. 5).

Although the present invention has been described in terms of the above embodiments, especially with reference to the accompanying drawings, it is not intended to be limited to the specific form described in such embodiments. Rather, the scope of the present invention is limited only by the accompanying claims. In the claims, the terms 'comprising' or 'including' do not exclude the presence of other integers or steps. Furthermore, although individually listed, a plurality of means, elements or method steps may be implemented by, for example, a single unit or processor. Additionally, although individual features may be included in different claims, these may possibly be advantageously combined, and the inclusion in different claims does not imply that a combination of features is not feasible and/or advantageous. In addition, singular references do not exclude a plurality. Thus references to "a", "an", "first", "second" etc do not preclude a plurality.

The invention claimed is:

1. A radiator for an RF (radio frequency) communication device including a first member including a first conducting surface operable to provide a first radiating surface, a second member including a second conducting surface operable to provide a near field reflector or ground plane, the first conducting surface and the second conducting surface being galvanically connected, wherein the first and second conducting surfaces arc substantially planar surfaces that are disposed in non parallel planes such that the first conducting surface is sloping at an oblique angle relative to the second conducting surface, the first conducting surface includes a first conducting region and a second conducting region separated by a gap, at least a portion of the gap is tapered, the radiator further comprising a contact area on the first conducting surface adjacent to the gap to receive a feed conductor to feed RF electrical signals to and from the first and second conducting regions, and a third conducting surface operable to provide a second radiating surface and disposed in a plane substantially perpendicular to the first and second conducting surfaces adjacent to an end of the gap distant from the contact area.

2. A radiator according to claim 1 wherein the first and second conducting regions are separate regions and the gap extends between the first and second conducting regions to separate them.

3. A radiator according to claim 1 wherein the first member comprises a first insulating substrate having thereon a first conducting layer providing the first conducting surface and the second member comprises a second insulating substrate having thereon a second conducting layer providing the second conducting surface.

4. A radiator according to claim 3 wherein the first insulating substrate has a shape which includes wing portions and at least a part of the first conducting region is on a first one of the wing portions and at least a part of the second conducting region is on a second one of the wing portions.

5. A radiator according to claim 4 wherein the wing portions are adjacent to a first edge of the first insulating substrate.

6. A radiator according to claim 5 wherein the first insulating substrate includes, between a second edge and a third edge of the first insulating substrate, a first bevelled corner and, between the third edge and a fourth edge of the first insulating substrate, a second bevelled corner and the wherein the first conducting surface is on a region of the insulating substrate including the first and second bevelled corners and itself has bevelled corners corresponding to the first and second bevelled corners of the first insulating substrate.

7. A radiator according to claim 5 including contact areas on each of the first and second conducting regions to receive a feed conductor, each of the contact areas being near the first edge of the first insulating substrate.

8. A radiator according to claim 6 wherein the gap extends from a location adjacent to the contact areas.

9. A radiator according to claim 7 wherein the gap includes a first elongate portion extending from a location of the first insulating substrate adjacent to the contact areas and a second elongate portion extending from and at an angle relative to the first elongate portion.

10. A radiator according to claim 9 wherein the first elongate portion of the gap has parallel sides and the second elongate portion of the gap is tapered, the width of the gap increasing with distance from the first portion of the gap.

11. A radiator according to claim 9 wherein the gap extends from a location near the first edge of the first insulating substrate to a location near a further edge of the first insulating substrate.

12. A radiator according to claim 11 wherein the first edge and the further edge of the first insulating substrate are perpendicular or approximately perpendicular to one another.

13. A radiator according to claim 11 wherein the first elongate portion and the second elongate portion of the gap are approximately perpendicular to one another.

14. A radiator according to claim 1 wherein the tapered portion of the gap has sides which are at an angle of between one degree and twelve degrees to one another.

15. A radiator according to claim 1 including a connector galvanically connecting the first conducting surface and the second conducting surface, the first conducting area having a surface area contacted by the connector which is less one tenth of the surface area of the second area.

16. A radiator according to claim 15 wherein the connector comprises a stub connector.

17. A radiator according to claim 1 wherein the first conducting surface and the second conducting surface are disposed at an angle relative to one another which is between ten degrees and twenty degrees.

18. A radiator according to claim 1 wherein the second conducting surface includes an edge having a recessed portion.

19. A radiator according to claim 18 wherein the recessed portion of the edge has sides which slope relative to one another.

20. A radiator according to claim 19 wherein the first conducting surface is galvanically connected to the second conducting surface near an end of the second conducting surface and the recessed portion is included in an edge of the second conducting surface at said end of the second conducting surface.

21. A radiator according to claim 20 wherein the first conducting surface slopes away from the second conducting surface such that a separation distance between the first conducting surface and the second conducting surface is greatest at an end of the first conducting surface which is nearest the end of the second conducting surface which includes the recessed portion.

22. A radiator according to claim 21 wherein the first conducting surface includes wing portions including the contact area, the edge of the first conducting surface being adjacent an end of the first conducting surface at which the separation distance between the first conducting surface and the second conducting surface is greatest.

23. A radiator according to claim 1 wherein the first and second radiating surfaces are operable to provide polarisation diversity for a given RF signal.

24. A radiator according to claim 1 wherein the first and second radiating surfaces are galvanically connected only by a stub connector.

* * * * *

UNITED STATES PATENT AND TRADEMARK OFFICE

CERTIFICATE OF CORRECTION

PATENT NO. : 7,728,775 B2
APPLICATION NO. : 11/736863
DATED : June 1, 2010
INVENTOR(S) : Shachar et al.

It is certified that error appears in the above-identified patent and that said Letters Patent is hereby corrected as shown below:

On the Title Page, Item (57), under "ABSTRACT", in Column 2, Line 11, delete "(601)" and insert -- (603) --, therefor.

IN THE CLAIMS;

In Column 8, Line 60, in Claim 1, delete "arc" and insert -- are --, therefor.

In Column 9, Line 29, in Claim 6, delete "and the wherein" and insert -- and wherein --, therefor.

Signed and Sealed this
Fifth Day of June, 2012

David J. Kappos

David J. Kappos
*Director of the United States Patent and Trademark Office*